US005813835A

United States Patent [19]

Corsmeier et al.

[11] Patent Number: 5,813,835

[45] Date of Patent: Sep. 29, 1998

[54] AIR-COOLED TURBINE BLADE

[75] Inventors: Robert J. Corsmeier; Harvey M. MacLin; Ching-Pang Lee, all of Cincinnati, Ohio

[73] Assignee: The United States of America as represented by the Secretary of the Air Force, Washington, D.C.

[21] Appl. No.: 746,688

[22] Filed: Aug. 19, 1991

[51] Int. Cl.[6] ..... B63H 1/14; F01D 5/14

[52] U.S. Cl. ..... 416/97 R; 416/96 R; 415/115

[58] Field of Search ..... 416/95, 96 R, 416/97 R, 97 A, 96 A, 90 R; 415/115, 116

[56] References Cited

U.S. PATENT DOCUMENTS

| | | | |
|---|---|---|---|
| 3,533,712 | 10/1970 | Kercher | 416/92 |
| 3,989,412 | 11/1976 | Mukherjee | 416/97 R |
| 4,012,167 | 3/1977 | Noble | 416/97 A |
| 4,063,851 | 12/1977 | Weldon | 416/97 |
| 4,135,855 | 1/1979 | Peill | 416/90 |
| 4,136,516 | 1/1979 | Corsmeier | 416/97 R |
| 4,185,369 | 1/1980 | Darrow et al. | 416/97 R |
| 4,278,400 | 7/1981 | Yamarik et al. | 416/97 |
| 4,330,235 | 5/1982 | Araki | 416/97 R |
| 4,462,754 | 7/1984 | Schofield | 416/97 R |
| 4,616,976 | 10/1986 | Lings et al. | 416/97 R |
| 4,650,949 | 3/1987 | Field | 416/90 R |
| 4,712,979 | 12/1987 | Finger | 416/96 R |
| 5,002,460 | 3/1991 | Lee et al. | 416/96 A |

*Primary Examiner*—Charles Jordan
*Assistant Examiner*—Theresa M. Wesson
*Attorney, Agent, or Firm*—Richard A. Lambert; Thomas L. Kundert

[57] ABSTRACT

An air-cooled gas turbine blade providing improved cooling characteristics is disclosed. The turbine blade includes several internal passages for conveying cooling air therethrough during turbine operation to provide the desired cooling effect. Two distinct passages are provided to cool the airfoil leading and trailing edges, respectively. Two serpentine cooling passages are disposed so as to efficiently cool each side of the airfoil. Disposed in the middle of the airfoil is an additional, distinct passage. The platform is cooled by three serpentine cooling passages. Two of these passages are in outlet fluid communication with the inlet to the middle airfoil passage. As cooling air traverses these two passages, heat is transferred, from the base simultaneously cooling it and warming the air. This warmed air is next directed through the middle airfoil passage, providing a slight warming effect to the center portion of the airfoil. This counteracts the tendency of the side cooling passages to over cool the center of the airfoil. In this way, a more uniform temperature gradient can be achieved throughout the airfoil, as well as the platform, minimizing internal stresses and enhancing blade operating characteristics.

9 Claims, 8 Drawing Sheets

AIR-COOLED TURBINE BLADE

RIGHTS OF THE GOVERNMENT

The invention described herein may be manufactured and used by or for the Government of the United States for all governmental purposes without the payment of any royalty.

BACKGROUND OF THE INVENTION

The present invention relates generally to airfoil blades for use in turbo machinery and more specifically to an air-cooled turbine blade utilizing a plurality of internal cooling passages to provide improved cooling characteristics.

The advantages of providing air-cooled turbine blades in gas turbine engines are well known. The need for cooling the blades stems from the well established principle that gas turbine efficiency increases as operating temperatures increase. Indeed, from the viewpoint of efficiency, it is desirable to operate the turbine at temperatures as high as possible. As a practical matter, the desired range of combustion temperatures for maximum efficiency exceeds the allowable temperature range of the turbine blades due to the limitation of their metallic alloy composition. Although some exotic alloys are better suited for high temperature operation, their costs tend to be prohibitive and thus, in order to economically produce turbines capable of sustained high temperature operation, a resort to cooling the blades was necessary.

A wide variety of air-cooled turbine blades have been developed as a result. They are similar in that each is hollow and incorporates one or more internal cooling passages. During turbine operation, a supply of pressurized air is directed from the compressor section through these passages to provide the desired cooling effect. The air is directed into the blade through one or more openings provided in the root. Being under a pressure greater than that within the turbine casing, the cooling air continues to travel through the internal passages within the airfoil section and is then exhausted into the turbine gas stream. In this way, the airfoil is cooled, and sustained, efficient turbine operation is made feasible.

As stated, a number of configurations of air-cooled turbine blades have been developed. For example, U.S. Pat. No. 4,180,373 to Moore et al discloses an air-cooled turbine blade incorporating several internal cooling passages. One passage is provided to cool the leading edge portion of the airfoil. A second, serpentine passage is provided to cool the center and both sides, as well as the trailing edge of the airfoil. Similarly, U.S. Pat. No. 3,533,712 to Kercher discloses an air-cooled turbine blade utilizing a multiplicity of cooling passages to provide the desired cooling effect.

Although somewhat effective, blades of this type have the tendency to be cooled unevenly. More specifically, during turbine operation, the concave side of the airfoil is subjected to higher temperatures than the opposite, convex side. This uneven cooling results from an inability of the single flow of cooling air, spanning the width of the airfoil, to efficiently address the differential heat loading on the two sides of the airfoil. This results in undesirable thermal stresses being imparted to the blade, adversely affecting performance.

In an attempt to provide a more efficient, localized cooling, attempts have been made to compartmentalize the cooling flows. For example, several blades utilizing perforated plates within the airfoil to provide a localized, impingement cooling have been developed. See, for example, U.S. Pat. No. 4,135,855 to Peill and U.S. Pat. No. 4,063,851 to Weldon. Again, while somewhat effective, blades at this type are not without the need for improvement. For example, the utilization of the internal plates increases blade complexity and manufacturing costs and can cause the buildup of undesirable internal stresses.

A need exists, therefore, for an improved air-cooled turbine blade. Such a blade would exhibit improved thermal characteristics during turbine operation, enhancing performance as well as blade longevity.

SUMMARY OF THE INVENTION

Accordingly, it is a primary object of the present invention is to provide an air-cooled turbine blade overcoming the limitations and disadvantages of the prior art.

Another object of the present invention is to provide an air-cooled turbine blade utilizing multiple cooling passages for assuring a substantially uniform temperature gradient across the blade.

Another object of the present invention is to provide an air-cooled turbine blade including cooling passages disposed so as to actively cool the platform of the turbine blade.

Yet another object of the present invention is to provide an air-cooled turbine blade including a distinct fluid cooling passage intermediate the two side cooling passages to assure more uniform blade cooling during turbine operation.

Still another object of the present invention is to provide an improved air-cooled turbine blade providing enhanced reliability and increased blade life.

Additional objects, advantages and other novel features of the invention will be set forth, in part, in the description that follows and will, in part, become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects and in accordance with the purposes of the present invention as described herein, an air-cooled turbine blade incorporates multiple internal cooling passages in the airfoil section of the blade, as well as in the platform, in order to provide improved cooling. During turbine operation, a substantially uniform temperature gradient is achieved enhancing blade reliability and longevity.

The preferred embodiment of the air-cooled turbine blade selected to illustrate the invention includes two distinct passages to cool the leading and trailing edges of the airfoil. Two distinct serpentine passages are disposed one adjacent each side of the airfoil for cooling thereof. This assures an efficient localized cooling to the extremely hot concave and less hot convex sides of the airfoil.

According to an important aspect of the present invention, disposed intermediate these two cooling passages is a third cooling passage for cooling the middle airfoil area. The cooling air supplied to this passage is from a different source. More specifically, the middle airfoil passage receives cooling air as exhausted from two serpentine cooling passages within the platform. Thus the air supplied thereto is prewarmed by the cooling of the platform before admission into the middle airfoil cooling passage. This has the desirable effect of providing adequate cooling to the central portion of the airfoil without overcooling it. This overcooling would result from the fact that the central portion of the airfoil is generally cooler during operation and requires less cooling than the outer sides of the airfoil. Indeed, it is a shortcoming of the teachings of the prior art that the cooling air directed through separate side cooling passages actually overcools the center of the airfoil. This leads to undesirable temperature gradients and a buildup of internal stress.

Advantageously, therefore, the undesirable effects of overcooling the central portion of the airfoil are avoided by the teachings of the present invention. Additionally, the platform is actively cooled providing enhanced blade longevity and reliability.

DESCRIPTION OF THE DRAWINGS

The invention will be more clearly understood from the following detailed description of representative embodiments thereof read in conjunction with the accompanying drawings wherein.

DETAILED DESCRIPTION OF THE INVENTION

Figure 12:
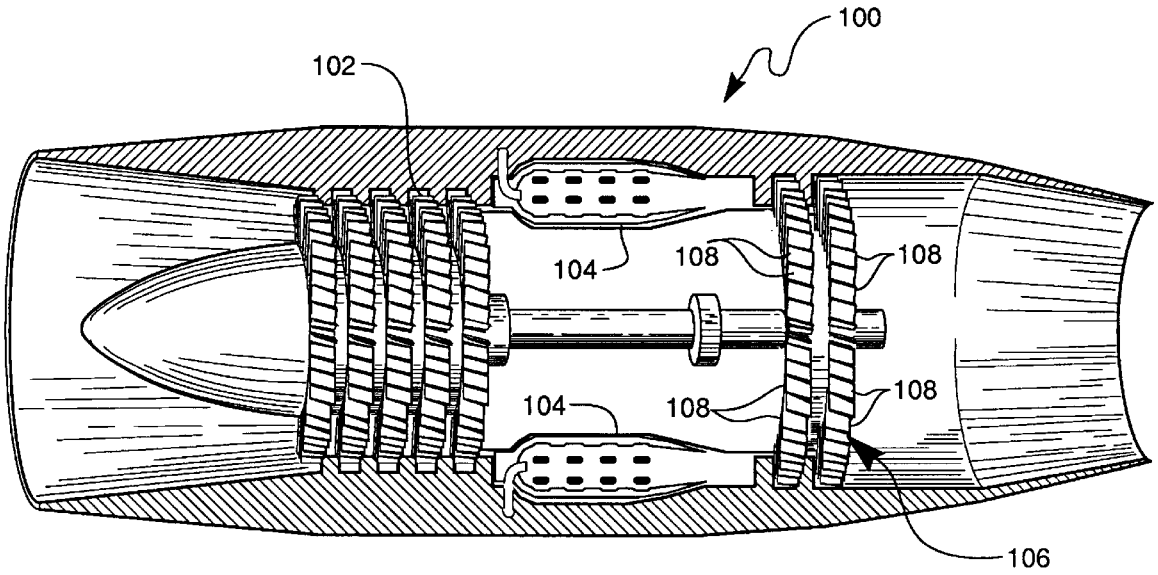
FIG. 12 is a cross sectional view of a representational gas turbine engine.

Reference is made to the drawing figures showing the air-cooled turbine blade of the present invention. As is known in the art, in a typical gas turbine engine 100 as shown in FIG. 12, a compressor section 102 receives atmospheric air and pressurizes it prior to admission into the combustion chambers 104 wherein it is ignited and further directed into the turbine section 106. The turbine section 106, powered by the expansion of the combustion gasses, provides the desired thrust, as well as the motive force for the compressor section 102.

Turbine efficiency increases with the temperature of combustion. A practical shortcoming of this is that the turbine blades 108 comprising the turbine section 106 are incapable of sustaining these higher temperatures over a long duration. As a result, various methods of cooling the blades have been developed.

Figure 3:
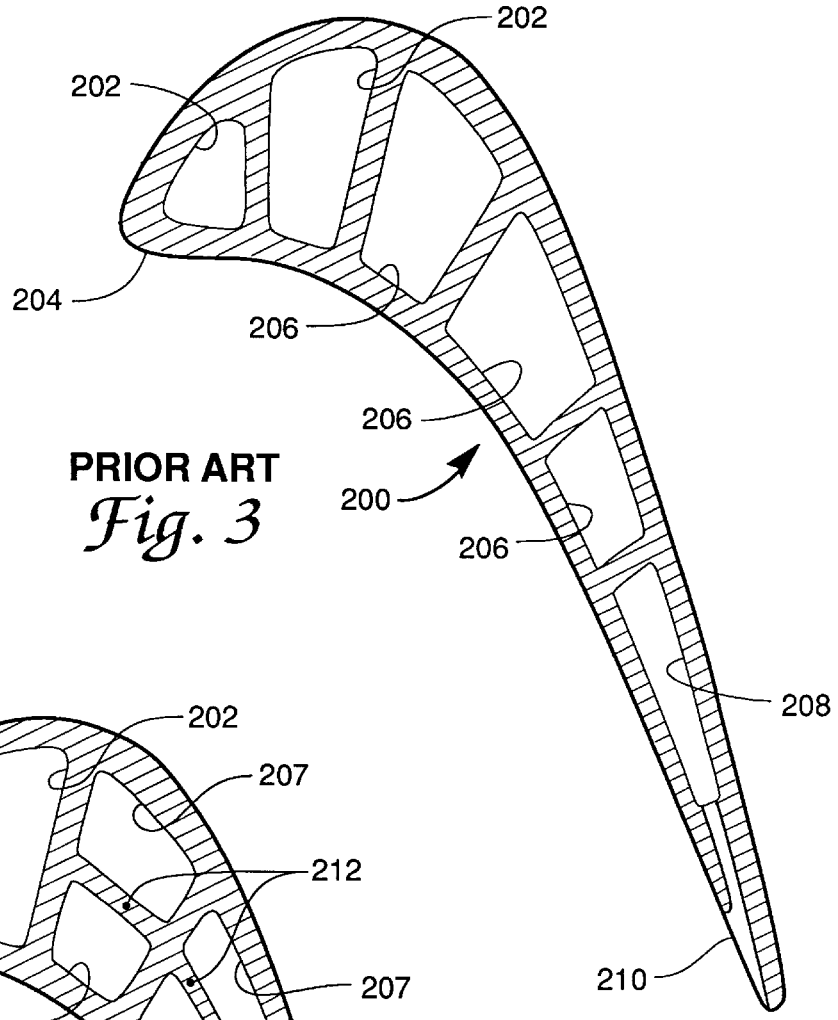
PRIOR ART Fig. 3
FIG. 3 is a cross sectional view of a prior art turbine blade.

For example, in a typical prior art turbine airfoil 200 (FIG. 3) several internal passages for the conveyance of cooling air therethrough are provided. A first set 202 cool the leading edge 204 of the airfoil 200. A second set 206 cools the airfoil 200 mid portion, as well as the sides. A third passage 208 is provided to cool the trailing edge 210 of the airfoil 200. This type of blade is somewhat effective but a need for improvement exists. For example, the cooling air directed through the second set of passages 206 is not generally effective in evenly cooling the differentially loaded sides of the airfoil. This is because the single flow of cooling air, spanning the width of the airfoil 200, is generally unable to adequately address the differential heat loading on the two sides of the airfoil.

Figure 3A:
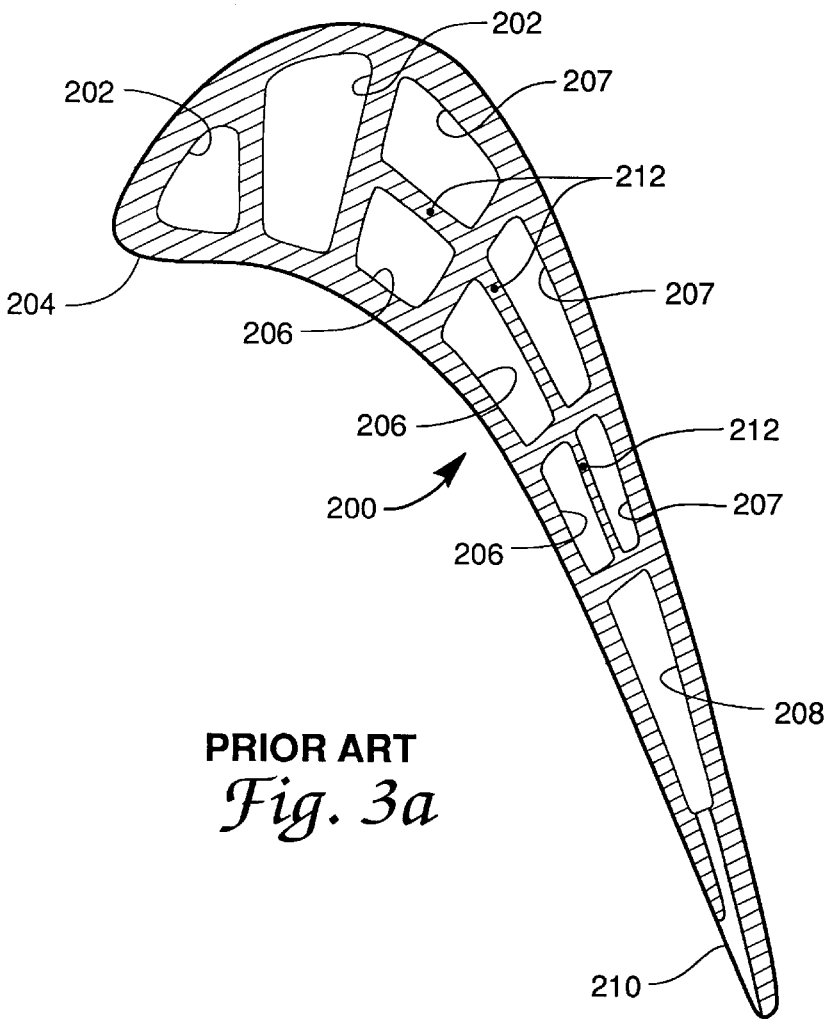
PRIOR ART Fig. 3a
FIG. 3*a* is a cross sectional view of another prior art turbine blade.

As shown in FIG. 3*a*, another type of prior art turbine blade, the passage 206 has been divided into two sets 206, 207 by the addition of a divider 212. In this way, the problem of differential heat loading can be more efficiently addressed, but now, an additional drawback appears. More specifically, the divider 212 is subjected to lesser temperatures during operation due to its protected location within the airfoil. Thus, the divider 212 tends to be over cooled by the flow of cooling air passing through the passages 206, 207. This leads to differential temperatures within the airfoil and an attendant buildup of undesirable thermal stresses negatively affecting blade reliability and longevity.

Figure 2:
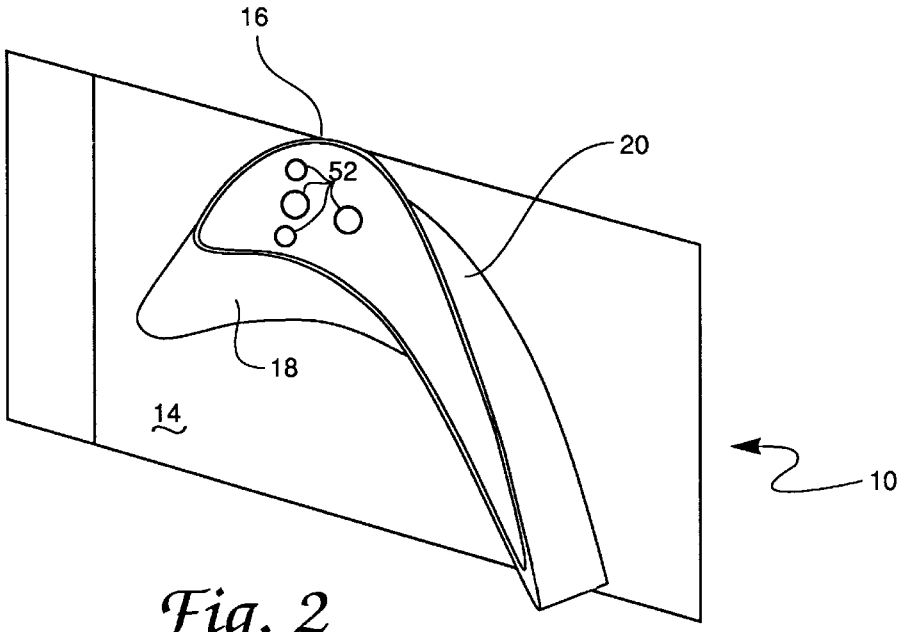
FIG. 2 is an elevational view of the air-cooled turbine blade of the present invention.
Figure 1:
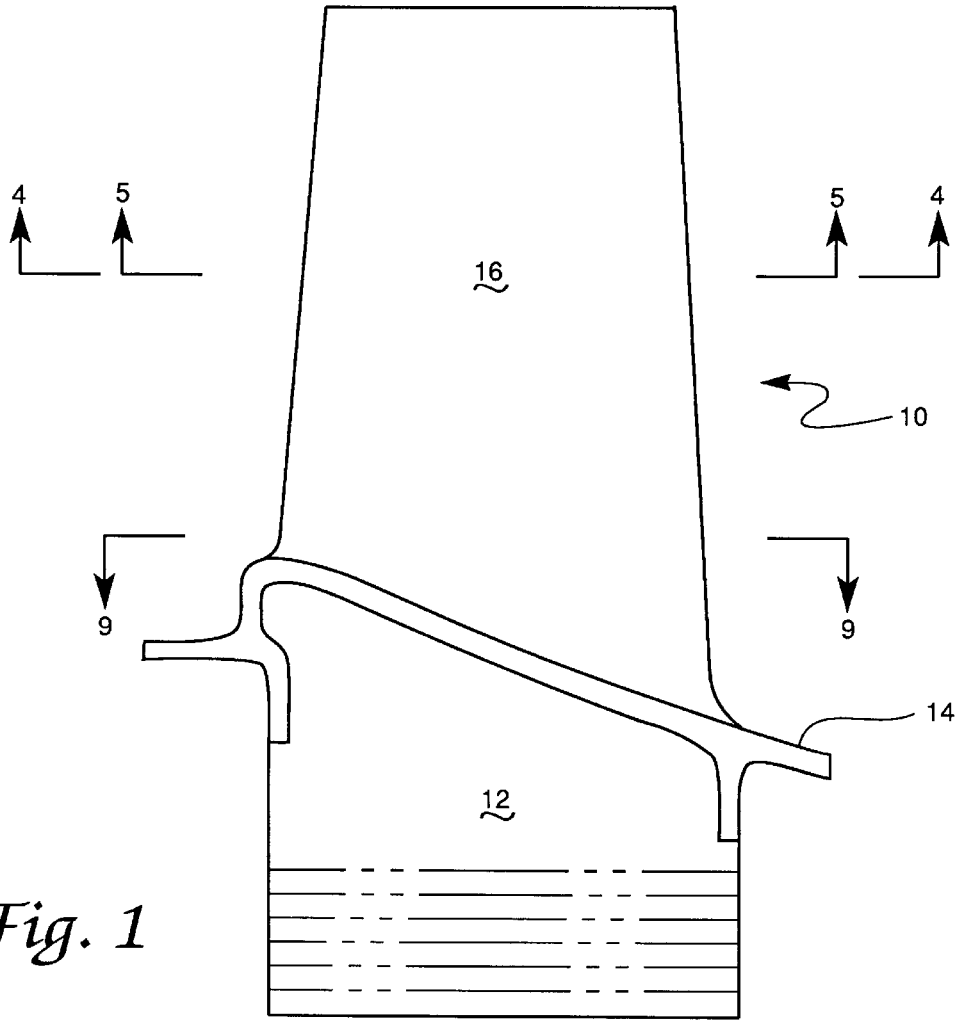
FIG. 1 is a plan view of the air-cooled turbine blade of the present invention.

Reference is directed to FIGS. 1 and 2, wherein the air-cooled turbine blade 10 of the present invention is illustrated. The turbine blade 10 includes a root 12 for mounting the blade to the turbine wheel (not shown), a platform 14 and an airfoil 16 formed integrally with the platform 14. The airfoil 16 includes a concave side 18 and a convex side 20. During operation of the turbine, combustion discharge gasses impinge on the concave side 18 of the airfoil 16. As can be appreciated, the concave side 18 of the airfoil 16 is subjected to higher temperatures during operation than the downstream, convex side 20.

Figure 4:
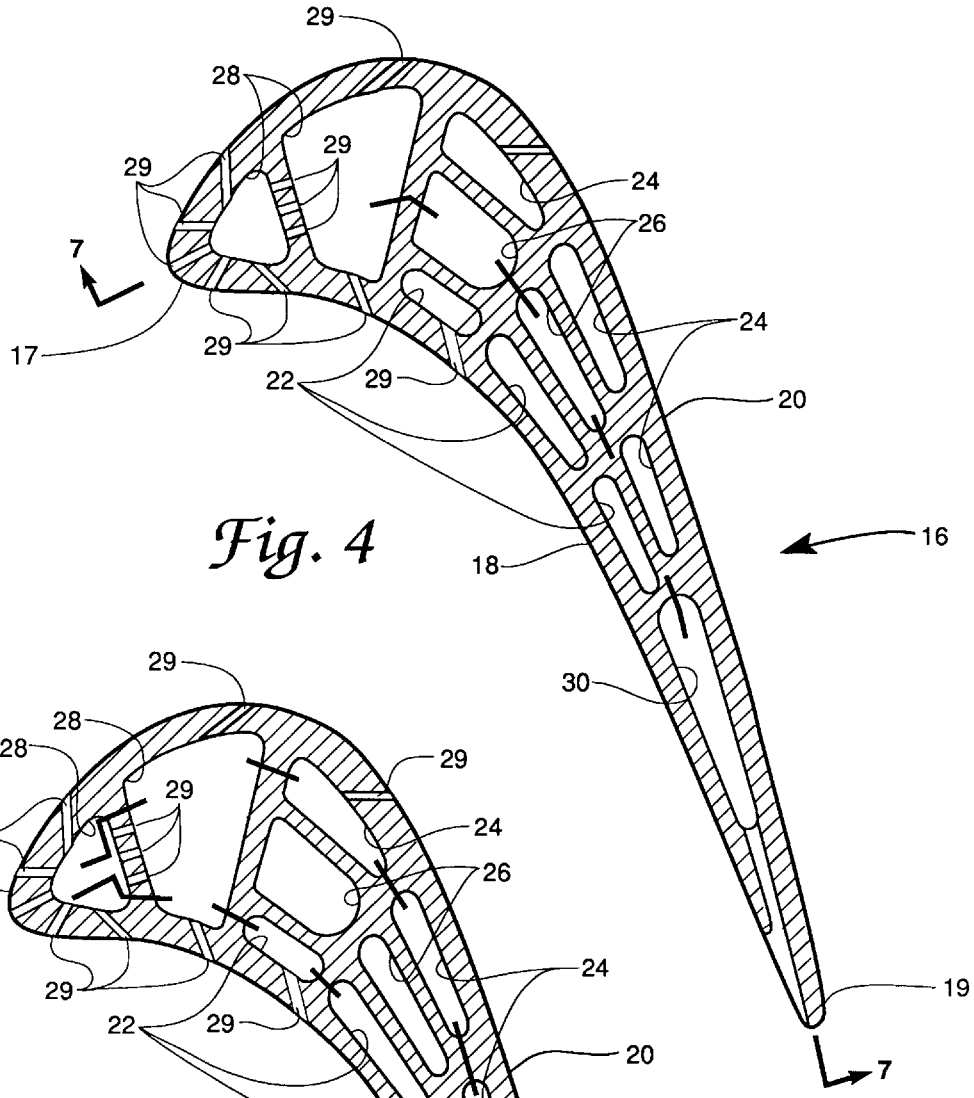
FIG. 4 is a sectional view taken along section lines 4—4 of FIG. 1.
Figure 5:
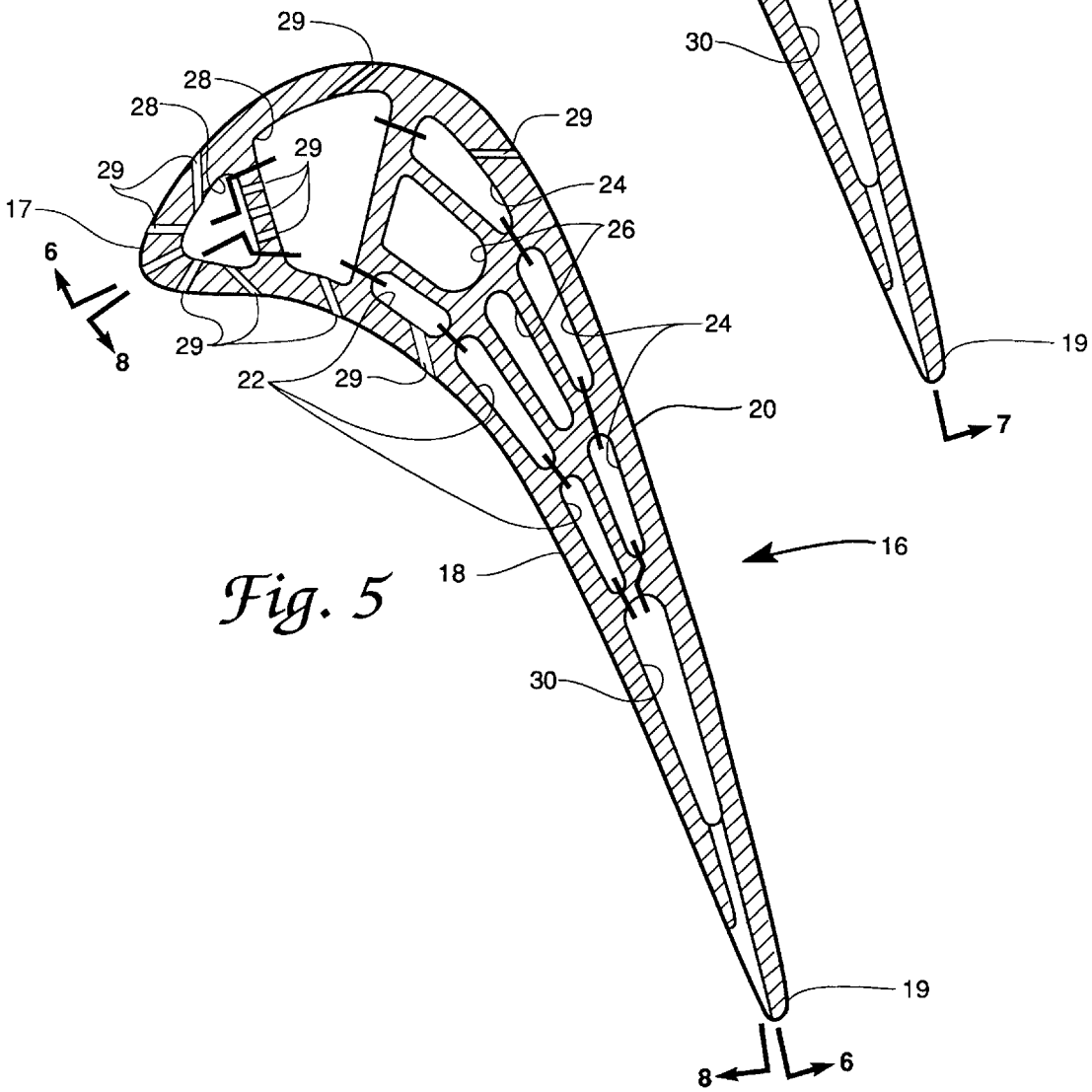
FIG. 5 is a sectional view taken along section lines 5—5 of FIG. 1.

Reference is now directed to FIGS. 4 and 5, sectional views of the airfoil 16. As will be described in move detail below, the airfoil 16 includes two serpentine side cooling passages 22, 24 and a third middle airfoil cooling passage 26. Additionally, a leading edge cooling passage 28, as well as a trailing edge cooling passage 30 are provided to effectively cool those areas (17 and 19 respectively) as well. As shown, various film cooling holes 29 are located in the leading edge 17, the concave side 18 and the convex side 20 of the airfoil 16 to exhaust at least some of the air in the associated passages and to provide a thin film of lower temperature air on the surfaces of the airfoil 16 for an additional cooling effect.

Figure 6:
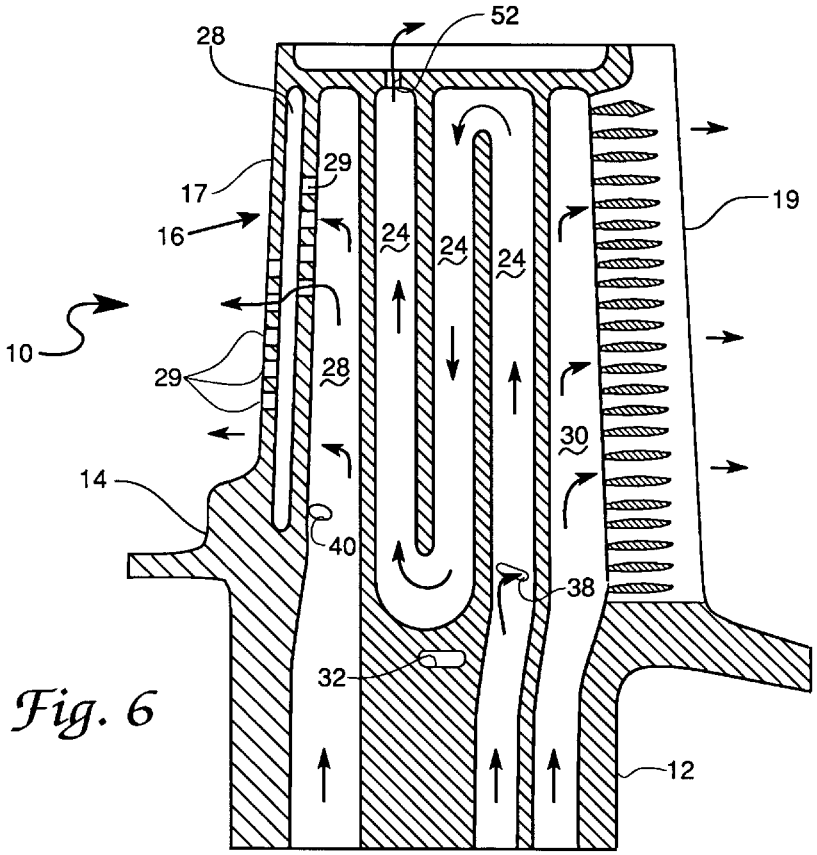
FIG. 6 is a sectional view taken along section lines 6—6 of FIG. 5.
Figure 8:
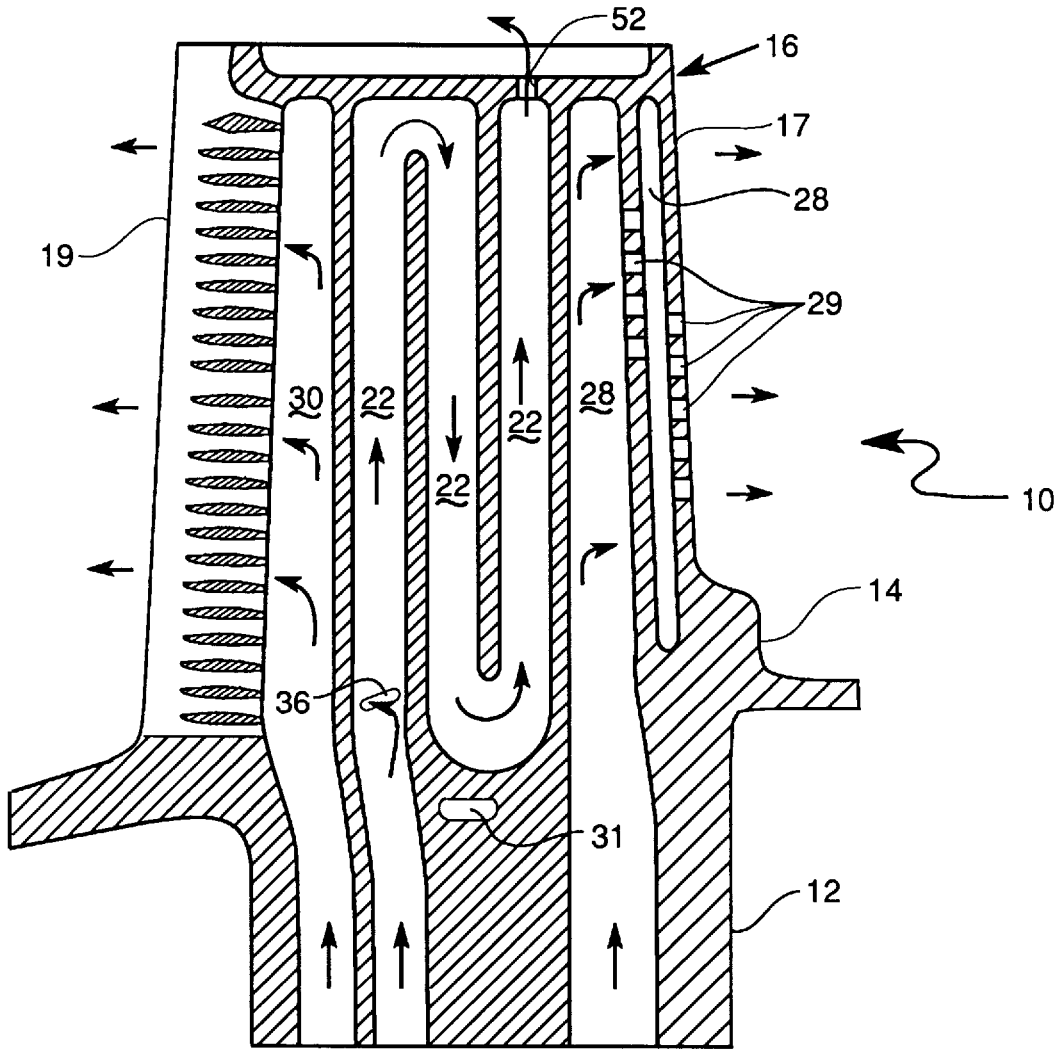
FIG. 8 is a sectional view taken along section lines 8—8 of FIG. 5.

As shown in FIGS. 6 and 8, the flow of cooling air, indicated by the arrows, is admitted into the turbine blade 10 through the root 12. The cooling air continues to travel in each passage within the airfoil 16 thereby cooling the surrounding metal surfaces. As shown in FIG. 8, the side cooling passage 22 directs the flow of air to "double back", changing direction twice before exiting at orifice 52, thus maximizing the cooling action over a large portion of the concave side 18 of the airfoil 16. As shown in FIG. 6, the side cooling passage 24 cools the convex side 20 of the airfoil 16 in a similar manner.

The air within the leading edge cooling passage 28 is ejected through the film cooling holes 29 providing the dual benefit of cooling the leading edge 17 as well as providing the film cooling as heretofore described. The air within the trailing edge cooling passage 30 is ejected across the height of the blade trailing edge 19.

Advantageously, a portion of the flow of the cooling air is utilized to cool the platform 14. Reference is made to FIG.

Figure 9:
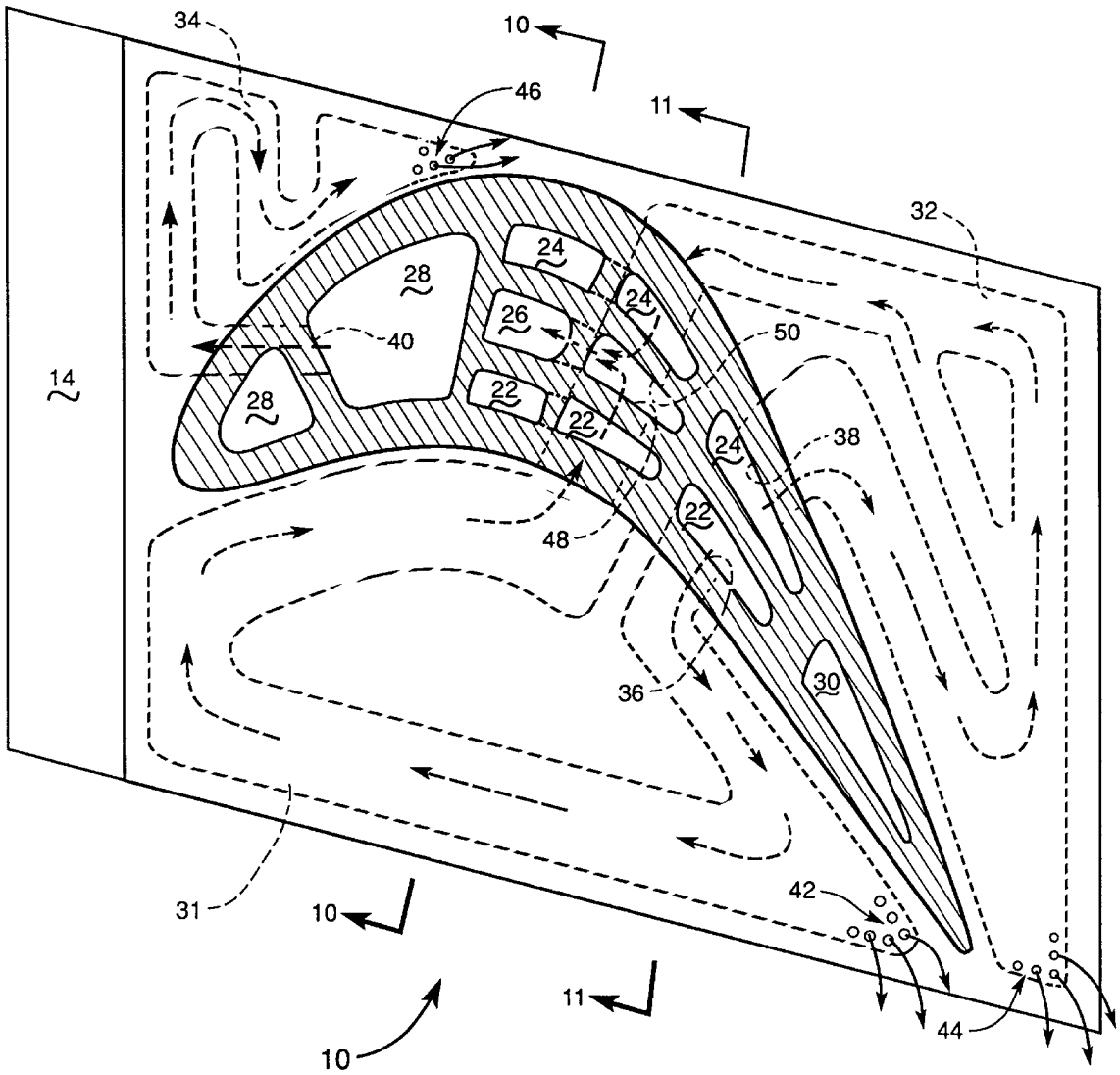
FIG. 9 is a sectional view taken along section lines 9—9 of FIG. 1.
Figure 10:
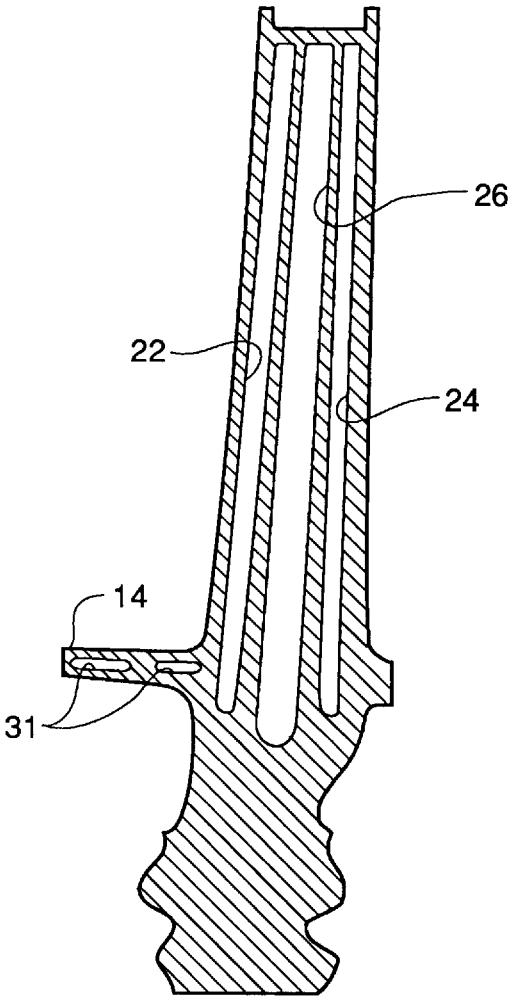
FIG. 10 is a sectional view taken along section lines 10—10 of FIG. 9.
Figure 11:
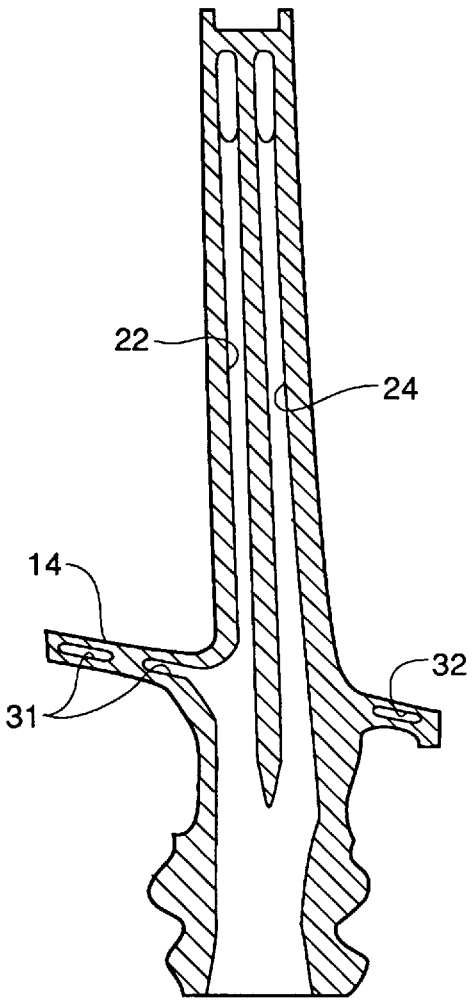
FIG. 11 is a sectional view taken along section lines 11—11 of FIG. 9.

9 taken along section line 9—9 of FIG. 1. As shown, three platform cooling passages 31, 32, and 34 are provided. See also FIGS. 10 and 11, illustrating the relative placement of passages 31 and 32 within the platform 14. As further shown in FIG. 9, orifices 36, 38, and 40 are in fluid communication with the cooling passages 22, 24, and 28 respectively, to provide the desired diversion of a portion of the cooling air into the platform cooling passages. Advantageously, a uniform cooling is maintained within the platform 14 by the provision of several sets of outlet orifices 42, 44 and 46. Thus a continuous flow of cooling air is directed into the corners to assure even cooling. It should be appreciated that the size and number of these outlet orifices can be readily varied in order to fit a wide variety of applications.

Figure 7:
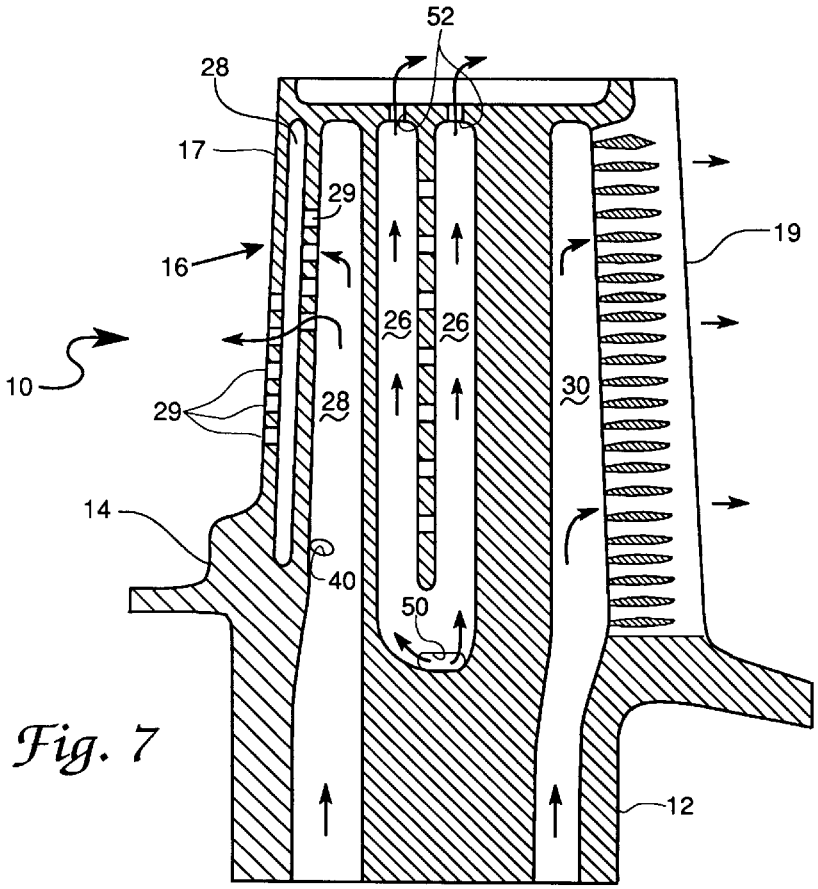
FIG. 7 is a sectional view taken along section lines 7—7 of FIG. 4.

Advantageously, and according to an important aspect of the present invention, an additional set of orifices 48, 50 are in outlet fluid communication with the platform cooling passages 31, 32 respectively. After passing through the platform cooling passages 31, 32 the cooling air (shown by the dashed arrows) enters the middle airfoil cooling passage 26 via these orifices 48, 50. Refer also to FIG. 7 wherein the orifice 50 is shown. In a like manner, entry of cooling air into the middle airfoil cooling passage 26 is also provided through the orifice 48. This arrangement has the two fold advantage of cooling the platform 14, as well as cooling the middle airfoil area. Moreover, the additional desirable result of cooling the middle airfoil area without overcooling it is achieved. More specifically, as the cooling air traverses the platform passage 31, 32 it is warmed. This warmed air is next directed through the middle airfoil cooling passage 26 via the orifices 48, 50 respectively to provide a lesser degree of cooling to the cooler middle airfoil area than is provided to the directly cooled concave 18 and convex side 20 of the airfoil 16. The cooling air then continues upwardly in the cooling passage 26 and ultimately exits through exit orifices 52.

In summary, numerous benefits have been described which result from employing the concepts of the present invention. In particular, the air-cooled turbine blade 10 of the present invention incorporates several passages 22, 24, 26, 28 and 30 for actively cooling the airfoil 16 during operation. Additionally, three passages 31, 32 and 34 are provided to cool the platform 14. Two of these passages 31, 32 exhaust into the middle airfoil cooling passage 26 to provide adequate cooling without overcooling thereof. This serves to evenly cool the entire blade 10 while minimizing temperature gradients. This helps assure greater turbine blade 10 reliability as well as longevity.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, additional orifices can be provided to direct fluid communication from the trailing edge cooling passage 30 to the platform cooling passages 31, 32. This would provide for a greater flow of cooling air within the platform. The embodiment was chosen and described to provide the best illustration of the principals of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally and equitably entitled.

We claim:

1. An air-cooled turbine blade, comprising:

a root having an upper platform;

an airfoil shaped body formed integrally with said platform, said body having a convex side and a concave side, a leading edge and a trailing edge;

a first cooling passage within said body adjacent said convex side;

a second cooling passage within said body adjacent said concave side;

a third cooling passage within said body intermediate said first and second cooling passages;

means for admitting cooling air into said first and second cooling passages;

a cooling passage within said platform having an outlet;

means for admitting cooling air into said platform cooling passage; and an orifice located at said outlet for providing fluid communication between said platform cooling passage and said third cooling passage.

2. The turbine blade according to claim 1, further including a fourth passage within said body adjacent said leading edge of said body.

3. The turbine blade according to claim 2, further including a fifth passage within said body adjacent said trailing edge of said body.

4. The turbine blade according to claim 3 further including a second platform cooling passage within said platform having an inlet, an outlet and a second orifice located at said inlet of said second platform cooling passage providing fluid communication between said second platform cooling passage and said fourth body cooling passage.

5. The turbine blade according to claim 4 further including a third platform cooling passage within said platform having an inlet, an outlet and a third orifice at said outlet of said third platform cooling passage providing fluid communication between said third platform cooling passage and said third body cooling passage.

6. The turbine blade according to claim 4 further including a second plurality of apertures extending through said platform in fluid communication with said second platform cooling passage.

7. The turbine blade according to claim 5 further including a third plurality of apertures extending through said platform in fluid communication with said third platform cooling passage.

8. The turbine blade according to claim 1 further including a plurality of apertures extending through said platform in fluid communication with said platform cooling passage.

9. The turbine blade according to claim 1 wherein said means for admitting cooling air into said platform cooling passage is an orifice for providing fluid communication between said platform cooling passage and one of said first or second body cooling passages.

* * * * *